US005269031A

United States Patent [19]

Alexander

[11] Patent Number: 5,269,031

[45] Date of Patent: Dec. 14, 1993

[54] DRIVE UNIT AND CLUTCH ASSEMBLY FOR AN ADJUSTABLE BED

[76] Inventor: James H. Alexander, R.R. No. 1, Acton, Ontario, Canada, L7J 2L7

[21] Appl. No.: 851,829

[22] Filed: Mar. 16, 1992

Related U.S. Application Data

[63] Continuation-in-part of Ser. No. 612,416, Nov. 13, 1990, Pat. No. 5,095,562.

[51] Int. Cl.[5] ..... A61G 7/06

[52] U.S. Cl. ..... 5/616; 5/620; 74/665 GE; 192/48.2; 192/48.9; 192/90; 192/83

[58] Field of Search ..... 5/616, 620, 613; 74/665 GE; 192/48.2, 48.9, 90, 83, 108

[56] References Cited

U.S. PATENT DOCUMENTS

| | | | |
|---|---|---|---|
| 1,810,317 | 6/1931 | Lasker | 192/83 |
| 3,129,607 | 4/1964 | Schaefer | 5/616 X |
| 3,349,877 | 10/1967 | Downs | 192/48.9 X |
| 3,917,042 | 11/1975 | Summa | 192/108 |
| 4,094,024 | 6/1978 | Benoit et al. | 5/616 |
| 4,174,547 | 11/1979 | Wetzler | 5/63 |
| 4,324,010 | 4/1982 | Houlberg et al. | 5/616 |
| 4,472,846 | 9/1984 | Volk, Jr. et al. | 5/69 |
| 4,545,084 | 10/1985 | Peterson | 5/69 |
| 4,854,923 | 8/1989 | Sexton et al. | 192/108 X |
| 5,095,562 | 3/1992 | Alexander | 5/616 |

*Primary Examiner*—Michael F. Trettel

*Attorney, Agent, or Firm*—Robert P. Simpson; Michael L. Dunn

[57] ABSTRACT

The present invention is a drive unit for an adjustable bed, comprising motor means and a clutch assembly comprising a toothed gear jack drive coupling, a toothed gear drive coupling and means for engaging and disengaging the jack drive coupling and the drive coupling, wherein the drive coupling is driven by the motor means and wherein the jack drive coupling, when engaged with the drive coupling by the clutch assembly, drives a controller shaft of the adjustable bed to raise or lower a section of the bed.

10 Claims, 8 Drawing Sheets

DRIVE UNIT AND CLUTCH ASSEMBLY FOR AN ADJUSTABLE BED

This is a Continuation-in-Part of Application Ser. No. 07/612,416 filed on Nov. 13, 1990 now U.S. Pat. No. 5,095,512.

BACKGROUND OF THE INVENTION

The present invention relates generally to adjustable beds, and more particularly to a single motor drive unit for an adjustable bed. The drive unit includes a toothed gear clutch assembly.

Adjustable beds are well known in the art and are used extensively in hospitals, nursing homes, and private homes by people who must spend extensive periods of time in bed for reasons of health, injury, or physical handicap. More recently, adjustable beds have gained in popularity for general home use by people who simply want to be more comfortable when sleeping, reading, watching television, etc.

In general, adjustable beds are categorized as either manual or powered. Manual beds utilize hand cranks to move the adjustable sections of the bed to the desired attitude and height, whereas powered beds use electric motors or hydraulic actuators to perform the same result.

Typically, both manual and powered beds have three, four, or even five articulated sections which may be separately adjusted. A common arrangement, for example, includes a head adjustment, a leg adjustment, and a bed height adjustment (which raises or lowers the entire bed). Usually, each adjustable section of the bed has a separate actuator, including a rotatable shaft, which turns in one direction to raise the section and in the opposite direction to lower the section.

There are advantages and disadvantages associated with both manual beds and powered beds. Manual beds are less expensive than powered beds and are usually simpler in construction, which makes them easier to repair. The disadvantages of a manual bed are the requirement that another person must be available to operate the bed (assuming the person in bed is bedridden), as well as the extra effort and awkwardness of turning the handcranks, etc. Powered beds are, of course, much easier to use and may even be controlled by the bedridden person himself. Motor-powered beds are substantially more expensive than manual beds, however, and are generally more difficult to repair as well.

Due to the high cost of powered beds, many people who require an adjustable bed in their home purchase or rent a manual bed. If, at a later time, the user wishes to upgrade to a powered bed, the general trend has been for the user to sell the manual bed and purchase a powered bed, or to trade in the manual bed and pay extra for the powered bed. This has generally necessitated that adjustable bed dealers carry inventories of both manual and powered beds. Another problem typically encountered with powered beds is that of repair. In very early models, a motor failure required a service call by a repairman and sometimes resulted in temporary loss of bed function until the motor problem was resolved. Improved beds provided an emergency handcrank which could be used to power the bed manually until the motor was repaired. A further improvement is disclosed in U.S. Pat. No. 4,545,084 (Peterson) which describes a modular drive arrangement for adjustable beds. The Peterson invention provides individually interchangeable motor and manual drive units which allegedly may be interchanged without disturbing the patient. Unfortunately, assuming a person is in the bed, it is necessary to crawl under the bed to interchange one of the Peterson drive units. To ensure sufficient clearance for the serviceman to be able to crawl under the bed, it is necessary that the bed have adjustable legs so that the entire bed can be raised off the floor (presumably the patient must be removed from the bed before this can be accomplished). Another problem with the Peterson bed is that the service person must troubleshoot a defective bed to determine which drive unit is in need of repair. To diagnose a defective bed, it is again necessary to crawl under the Peterson bed to determine which drive unit is defective, or else remove the mattress and bedding (and the patient) to enable a visual inspection of the moving parts.

A variety of drive units are known for powered beds. Some beds utilize hydraulic or pneumatic actuators, while others use electric motors. Among those powered by electric motors, some use multiple motors per bed, usually one motor for each drive shaft. An advancement over this scheme is a bed which uses a single motor and appropriate coupling mechanisms to activate particular drive shafts.

One example of a single-motor drive unit for an adjustable bed is disclosed by Houlberg et al. in U.S. Pat. No. 4,324,010. Houlberg et al. use a unidirectional motor which necessitates a more complex clutch assembly comprising eight solenoids and two gears per drive shaft.

U.S. Pat. No. 4,472,846 (Volk, Jr. et al.) discloses a coupling system for an adjustable bed which utilizes a single reversible motor which drives one or more adjusting mechanisms through individual clutches. According to the patent, a salient feature of the invention is the use of a relatively light (i.e., weak) restoring spring to disengage the clutch and corresponding less powerful solenoids to overcome the spring when engaging the clutch. Unfortunately, it is necessary to unload each clutch prior to disengagement to prevent the clutch mating surfaces from locking or binding after the solenoid has been de-energized. This unloading is accomplished by momentarily reversing the direction of the bidirectional motor which jogs the gear train sufficiently to take the forces off of the clutch so that it can release. This requires complex control circuitry as shown in FIGS. 18 and 19.

What is needed, then, is a coupling mechanism for a bi-directional single-motor drive unit which comprises a clutch which will not bind up upon disengagement and does not require reversing the motor to accomplish disengagement.

Finally, adjustable beds are, of course, usually more complicated in construction than conventional beds. Due to this more complex construction, it is generally more difficult to disassemble, transport and reassemble adjustable beds. This is especially troublesome in that there is usually a much greater need to transport adjustable beds than conventional beds.

SUMMARY OF THE INVENTION

The present invention is a drive unit for an adjustable bed, comprising motor means and a clutch assembly comprising a toothed gear jack drive coupling, a toothed gear drive coupling and means for engaging and disengaging the jack drive coupling and the drive coupling, wherein the drive coupling is driven by the motor means and wherein the jack drive coupling, when engaged with the drive coupling by the clutch assembly, drives a controller shaft of the adjustable bed to raise or lower a section of the bed. The invention also includes an adjustable bed and drive unit therefor, comprising a bed frame, a plurality of separately adjustable bed sections pivotally secured to the frame, a corresponding plurality of controller shafts wherein each shaft controls one of the adjustable sections, a drive unit operatively arranged for controlling and driving the controller shafts, wherein the drive unit comprises motor means, a separate clutch assembly for each controller shaft which clutch assembly comprises a toothed gear jack drive coupling, a toothed gear drive coupling and means for engaging and disengaging the jack drive coupling and the drive coupling, and, means for coupling the motor means to the clutch assembly, wherein the drive coupling is driven by the motor means and wherein the jack drive coupling, when engaged with the drive coupling by the clutch assembly, drives a controller shaft of the adjustable bed to raise or lower a section of the bed.

A primary object of the invention is to provide a drive unit for an adjustable bed which uses a single electric motor to drive a plurality of drive shafts of the bed and includes a toothed gear clutch assembly which does not bind up when disengaging.

These and other features, advantages and objects of the present invention will be appreciated by those having ordinary skill in the art in view of the following specification, claims and appended drawings.

DETAILED DESCRIPTION OF THE INVENTION

Figures 1, 2:
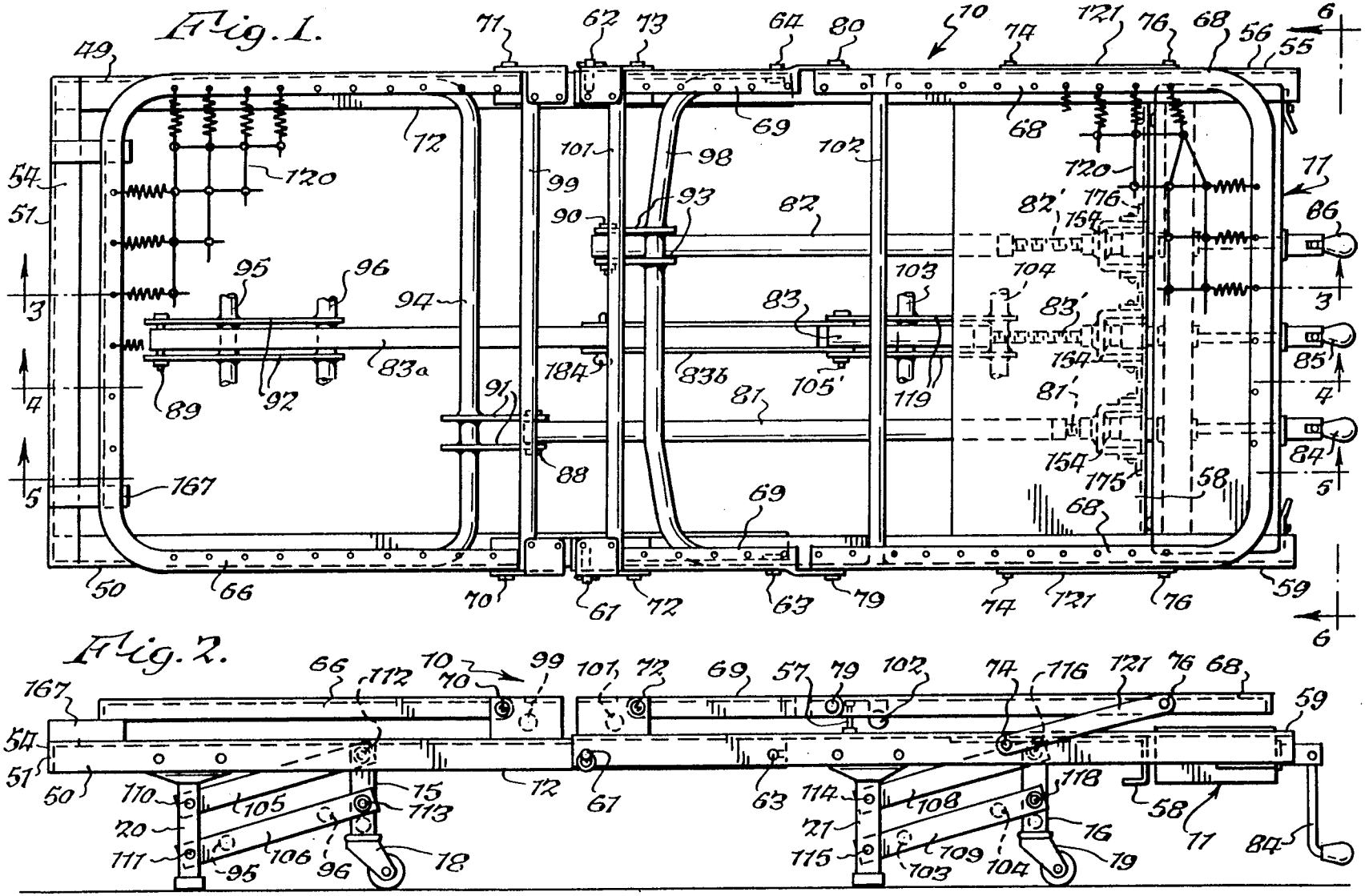
FIG. 1 is a top plan elevation of the adjustable bed of the invention with the manual drive unit installed.
FIG. 2 is a side elevation of the adjustable bed shown in FIG. 1.

For purposes of the description which follows, the terms flupperill "lower", "left", "right", "front", "rear", "vertical", "horizontal", and derivatives thereof, refer to the invention as illustrated in the drawings from the perspective of a normal observer facing the drawings. The terms "foot" and "foot-end" refer to the end of the bed where the drive unit is secured, and where the user's feet would usually be, whereas the terms "head" and "head-end" refer to the opposite end of the bed, where the user's head would normally be. "Bind-up" refers to a failure of a clutch to disengage when its driving solenoid is de-energized. Identical drawing reference numbers on different drawing FIGURES refer to identical elements.

What follows is a description of a preferred embodiment of the invention, illustrating the best mode of the invention known to the patentee. The claims are not intended to be limited in scope to the preferred embodiment described herein, but rather are intended to encompass variations thereof which are readily apparent to those having ordinary skill in the art. For example, an important point of novelty of the invention is the interchangeability of manual and powered drive units, where each unit controls a plurality of bed drive shafts and associated bed positions. In the preferred embodiment depicted, three separate drive shafts are shown for controlling the head, foot and general elevation of the bed, respectively. It is not intended that the claims of the invention be limited in scope to a bed with three drive shafts, however. The present invention is intended for adjustable beds with two, three, four, five or even more separately adjustable sections. The essence of the invention is that it permits the quick and easy interchangeability of the drive unit for the entire bed, regardless of how many separately adjustable sections the bed may have.

Similarly, the preferred embodiment shown includes a first powered drive unit with three electric motors, and a second powered drive unit with a single electric motor. However, the claims are not intended to be limited to a particular number of electric motors in the powered drive unit, nor is it necessary that the powered drive unit include electric motors at all; for example, hydraulic or pneumatic actuators could be employed as well.

Adverting now to the drawings, FIG. 1 is a top plan elevation of the adjustable bed 10 of the invention with manual drive unit 11 installed, and FIG. 2 is a side elevation of the bed shown in FIG. 1. It is to be noted that FIG. 2 illustrates the left side of the bed as viewed from the perspective of one facing the foot end of the bed. Although not completely shown in the drawings, the right side of the bed is identical to the left side, and so a detailed description thereof has been generally omitted for simplicity.

Bed 10 is generally of conventional construction, but with several important modifications to accommodate the interchangeability of the drive units and to facilitate nesting of the bed frame for easier storage and transport. The bed comprises frame 12 which is supported by dual head-end legs 15 which rest on casters 18, and dual foot-end legs 16 which rest on casters 19, and is sometimes also supported by head-end vertical support 20 and foot-end vertical support 21 (when the bed frame is not in an elevated position). (For convenience, reference numbers 15 & 16, 18 & 19, and 20 and 21 denote pairs of legs, casters and vertical supports, respectively, half of which pairs are shown in FIG. 2) . A conventional spring-wire mattress support 120 covers the head, center and foot sections of the bed.

Frame 12 comprises head-end support section 54 and foot-end support section 55. Head-end support section 54 comprises side rails 49 and 50, transverse member 99, and head rail 51, all of which may, for example, be individually constructed of tempered steel and then welded together or otherwise secured. Similarly, foot-end support section 55 comprises side rails 56 and 59, transverse members 101 and 102, and coupling mounting bracket 58 which extends transversely across the side rails. Once again, the side rails may, for example, be constructed of tempered steel and welded or otherwise secured to the mounting bracket.

The respective side rails of the two U-shaped support sections 54 and 55 telescopingly engage one another and are joined together by locking pins 61 and 62 which pass through aligned bores in the side rails. For added stability and ease in alignment side rails 56 and 59 include inwardly protruding pins 63 and 64, respectively, which engage corresponding slots in the ends of side rails 50 and 49, respectively. Pins 61 and 62 may be easily removed to disassemble the bed.

Figures 3, 4, 5:
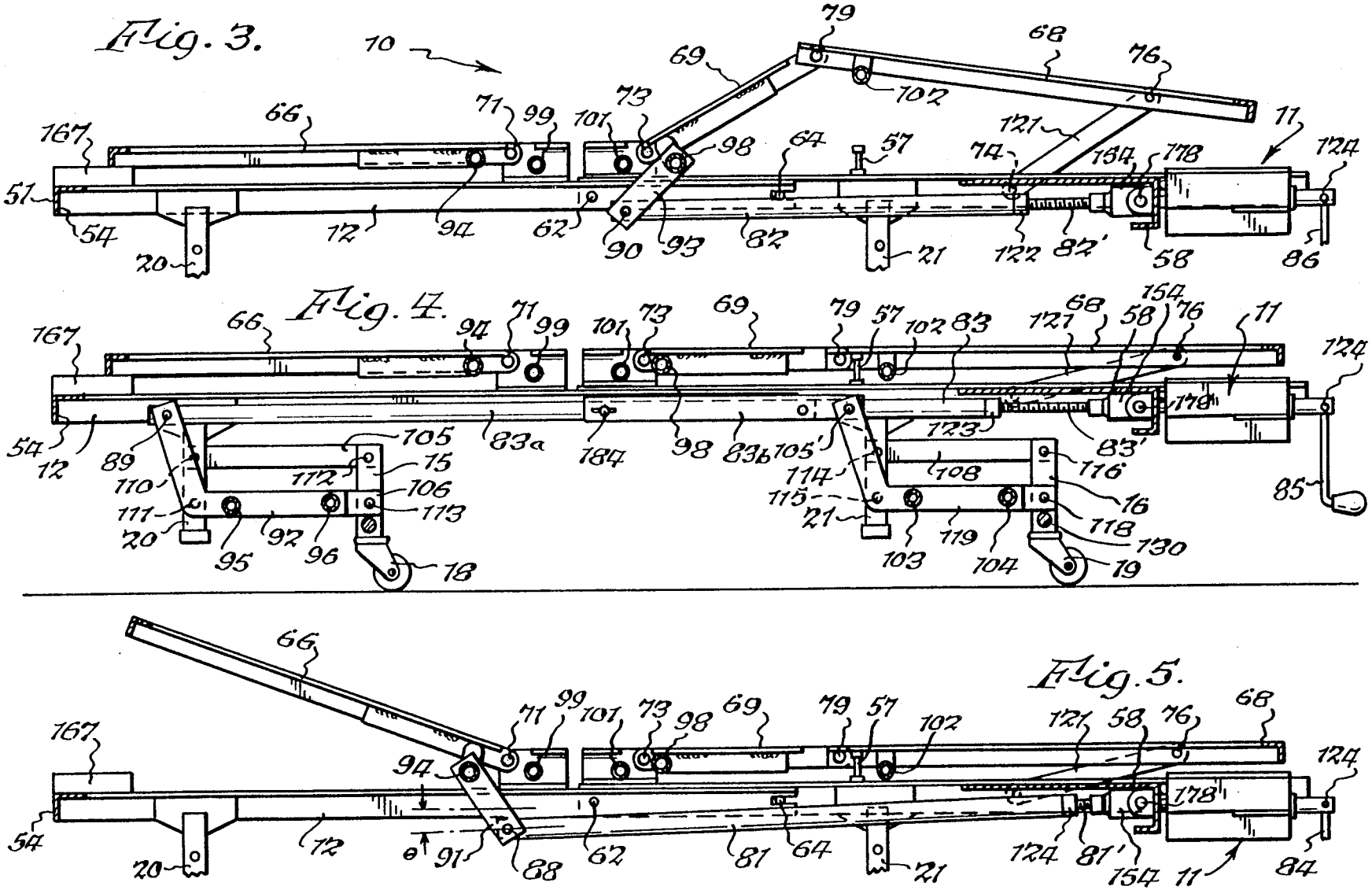
FIG. 3 is a vertical cross-section of the bed with sections cut away, taken generally at line 3—3 of FIG. 1. with the adjustable foot section in an elevated position.
FIG. 4 is a view similar to FIG. 3, except taken generally at line 4—4 of FIG. 1.
FIG. 5 is a view similar to FIGS. 3 and 41 except taken generally at line 5—5 of FIG. 1.

Bed 10 includes a pivoting head section 66, pivoting foot and center sections 68 and 69, respectively, as well as a general elevation adjustment of frame 12 (as best shown in FIG. 4). Head section 66 pivots about pivot pins 70 and 71; and foot and center sections 68 and 69 pivot about stationary pivot pins 72, 73, 74 and 75, and moving pivot pins 76, 781 79 and 80.

As best illustrated in FIG. 1, conventional screw jacks 81 and 82 are used to control the attitude of head section 66 and foot and center sections 68 and 69, respectively. Conventional screw jack 83 controls the general elevation of frame 12. Hand crank 84 turns controller shaft 81' which in turn drives jack 81; hand crank 85 turns controller shaft 83' which in turn drives jack 83; and hand crank 86 turns controller shaft 82' which in turn drives jack 82. Drive jack 81 is pivotally secured at pivot pin 88 to bracket 91 which is fixedly secured to transverse member 94 of head section 66. Drive jack 82 is pivotally secured at pivot pin 90 to bracket 93 which is fixedly secured to transverse member 98 of foot and center sections 68 and 69. Drive jack 83 is pivotally secured at pivot pin 89 to bracket 92 which is fixedly secured to transverse frame members 95 and 96. As shown in FIG. 21 transverse members 95 and 96 are fixedly secured to pivoting cross member 106 which, in turn, is pivotally secured to leg 15 at pivot pin 113 and to vertical support 20 at pivot pin 111. Pivoting cross member 105 is also pivotally secured to leg 15 at pivot pin 112 and to vertical support 20 at pivot pin 110. Drive jack 83 is pivotally secured at pivot pin 051 to bracket 119 which is fixedly secured to transverse frame members 103 and 104. Also as shown in FIG. 2, transverse members 103 and 104 are fixedly secured to pivoting cross member 09 which, in turn, is pivotally secured to leg 16 at pivot pin 18 and to vertical support 21 at pivot pin 115. Pivoting cross member 108 is also pivotally secured to leg 16 at pivot pin 116 and to vertical support 21 at pivot pin 114.

Figures 13, 14:
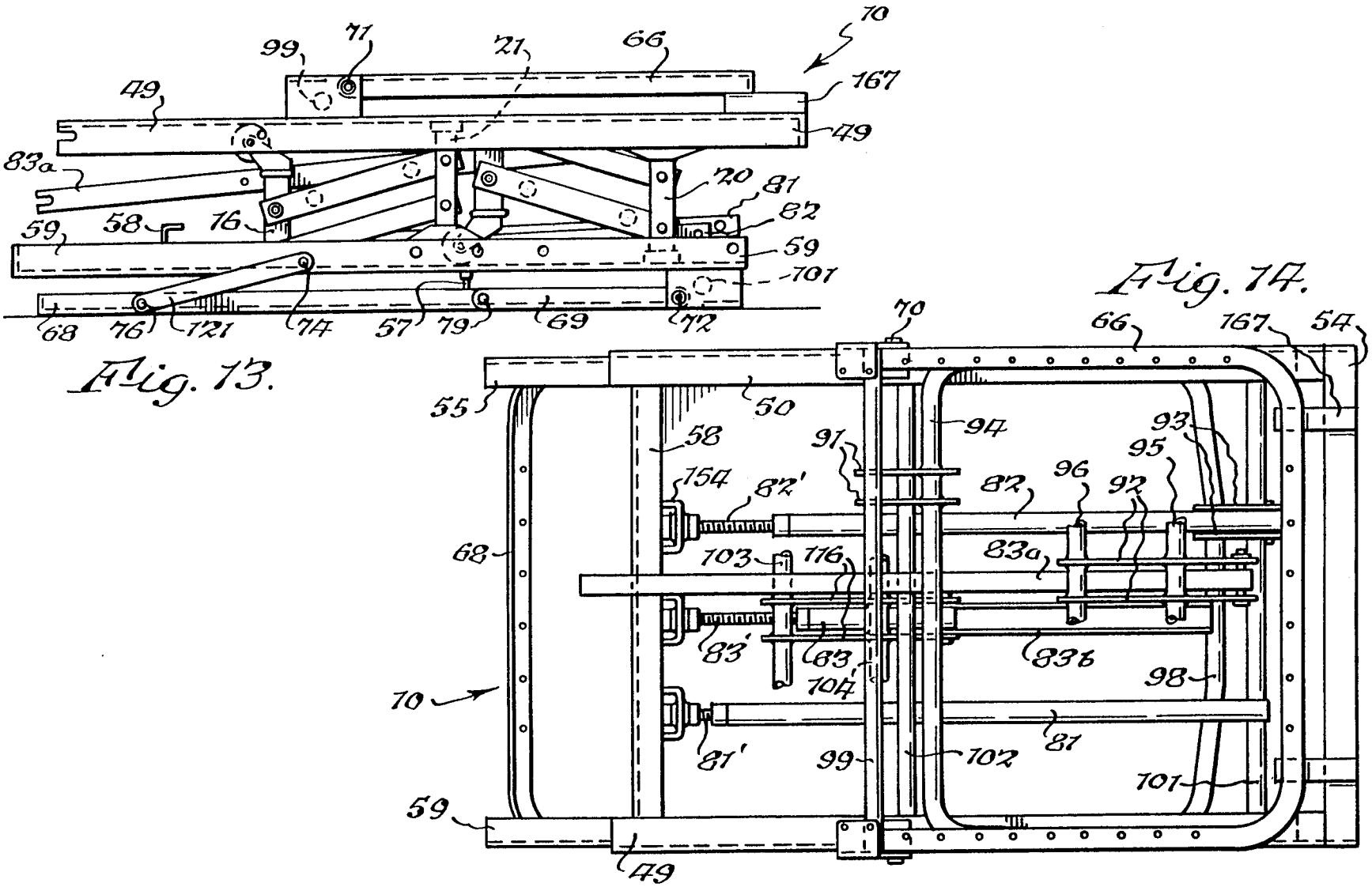
FIG. 13 is a side elevation of the adjustable bed of the invention, illustrating how the bed may be separated into two pieces which nest together which makes the bed easier to transport or store.
FIG. 14 is a top plan elevation of the bed shown in FIG. 13.

The bed's various functions are best illustrated by reference to FIGS. 3—5. FIG. 3 is a vertical cross-section of the bed with sections cut away, taken generally at line 3-3 of FIG. 11 with adjustable foot section 68 and center section 69 in an elevated position. To elevate foot section 68 and center section 69 as shown, hand crank 86 is rotated in a clockwise direction (from a perspective facing the foot-end of the bed). Hand crank 86 drives shaft 821 into the hollow tube of jack 82. Shaft 821 engages nut 122 which is secured inside the hollow tube of jack 82. As controller shaft 821 rotates in a clockwise direction, jack 82 travels rightwardly, causing bracket 93 through its mounting on center section 69 to pivot in a counterclockwise direction about hinge pivots 72 and 73, thereby rotating transverse member 98 and center section 69 about pivots 72 and 73 which are secured to center section 69. As center section 69 pivots in a counterclockwise direction, it raises the leftward end of foot section 68, which is pivotally secured to section 69 at pivot pin 79. As foot section 68 moves generally leftward, it causes member 121 to pivot in a counterclockwise direction about pivot pin 74 which is secured to frame 12. Turning hand crank 86 in the opposite direction lowers sections 68 and 69. It is important to note that when sections 68 and 69 are fully lowered, the left end of section 68 rests on stop 57 (as shown in FIGS. 21 4 and 5) which is welded to the frame. Stop 57 serves two functions; it absorbs the force exerted by one sitting on the foot end of the bed and, as shown in FIG. 13, it helps to align the bed halves when nesting the halves together. Head rest 167 (shown in FIGS. 2-5), which is also welded to the frame, similarly functions to support head section 66.

FIG. 4 is a view similar to FIG. 31 except taken generally at line 4-4 of FIG. 1, and illustrates how hand crank 85 controls the general elevation of frame 12. To elevate frame 12 as shown, hand crank 85 is rotated in a clockwise direction (from a perspective facing the foot-end of the bed) .It should be noted that the handle of hand crank 85 pivots about pin 124 to enable its handle to clear the other handles when cranking (the other two handles also include this pivoting feature) Hand crank 85 drives shaft 83' into the hollow tube of jack 83

(which includes head section 83*a* and foot section 83*b*). Shaft 83' engages nut 123 which is secured inside the hollow tube of jack 83. As controller shaft 83' rotates in a clockwise direction, jack 83 travels rightwardly, causing upward forces along legs 20 and 21, and downward forces along legs 15 and 16, which results in the left ends of brackets 119 and 92 raising the bed off the floor. Since transverse members 103 and 104 are secured to bracket 1191, and transverse members 95 and 96 are secured to bracket 92, these transverse members are also elevated relative to the floor. Finally, transverse members 95 and 96 are secured to member 106 (see FIG. 2), and transverse members 103 and 104 are secured to member 109 (see FIG. 2), and members 106 and 109 are pivotally secured to legs 20 and 21 which are rigidly secured to frame 12. Thus it is seen that turning the handcrank in a clockwise direction results in elevating frame 12 whereas turning hand crank 85 in the opposite direction lowers frame 12.

FIG. 5 is a view similar to FIGS. 3 and 4, except taken generally at line 5–5 of FIG. 1. To elevate head section 66 as shown, hand crank 84 is rotated in a clockwise direction (from a perspective facing the foot-end of the bed). Hand crank 84 drives shaft 81' into the hollow tube of jack 81. Shaft 811 engages nut 124 which is secured inside the hollow tube of jack 81. As controller shaft 81' rotates in a clockwise direction, jack 81 travels rightwardly, causing bracket 91 to pivot in a clockwise direction about pivot pin 88, thereby raising transverse member 94 which is secured to bead section 66. Turning hand crank 84 in the opposite direction lowers section 66.

Thus it is seen in FIGS. 3–5 that turning the appropriate crank in a clockwise direction elevates its associated bed section, whereas turning the crank in a counterclockwise direction lowers the particular section.

Figures 6, 7, 8, 9:
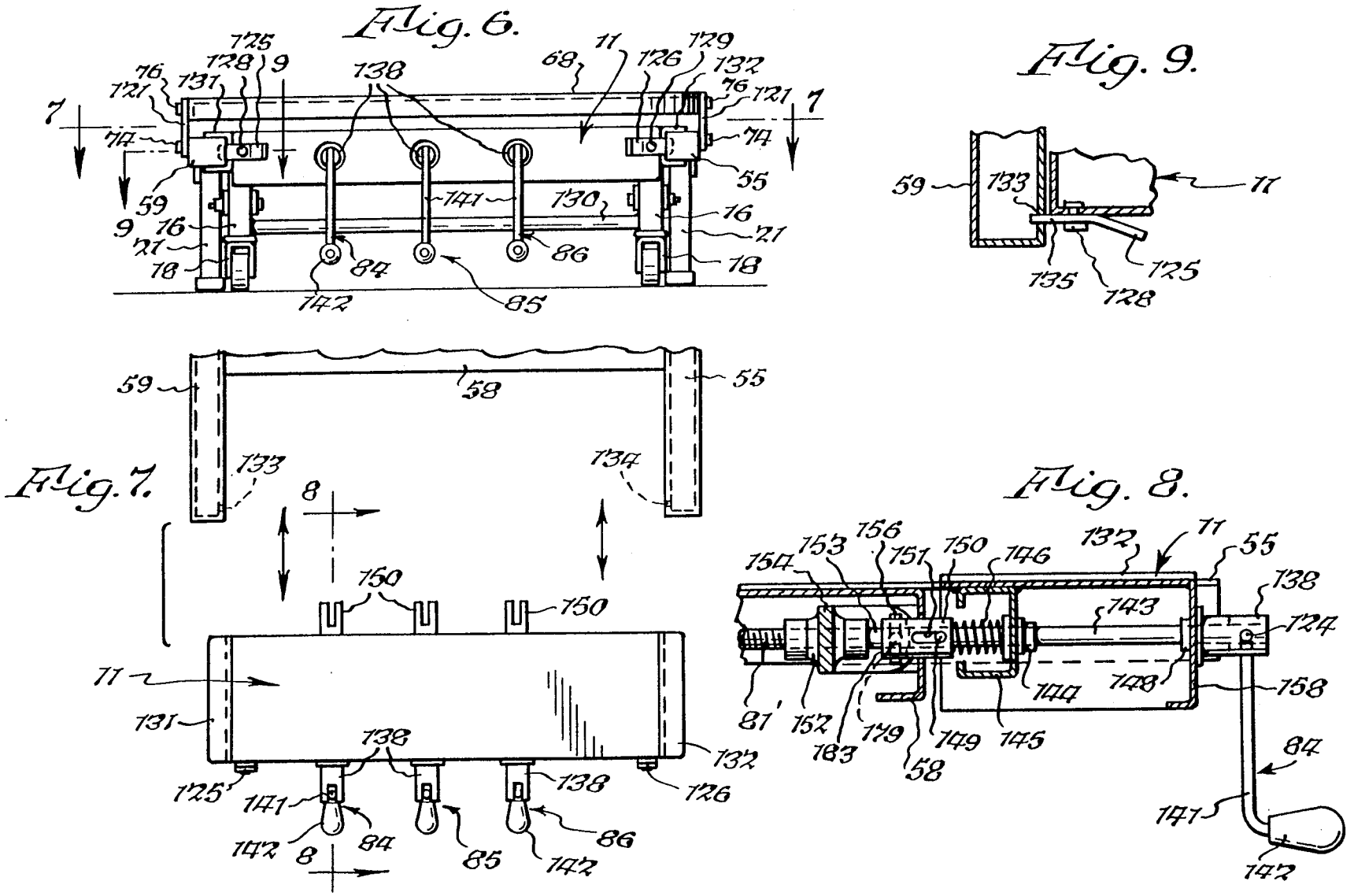
FIG. 6 is a foot-end elevation of the bed of FIG. 1.
FIG. 7 is a fragmentary horizontal cross-section of the bed taken generally at line 7—7 of FIG. 61 which illustrates how the manual drive unit slidingly engages the foot-end of the bed frame.
FIG. 8 is a vertical cross-section of the manual drive unit and coupling taken generally at line 8—8 of FIG. 7, showing the unit in engagement with the bed parts.
FIG. 9 is a fragmentary section taken generally at line 9—9 of FIG. 6 which illustrates how the drive unit latches onto the bed frame.

FIG. 6 is a foot-end elevation of the bed of FIG. 1. showing manual drive unit 11 installed. Also shown in FIG. 6 are quick connect/disconnect latches 125 and 126 which are pivotally secured to drive unit 11 at pivot pins 128 and 129, respectively. Secured to the housing of drive unit 11 are mounting brackets 131 and 132 which slidingly engage square-shaped side rails 59 and 55., respectively. Once the drive units are slid into position, the latches interlock the drive unit with the side rails as shown in more detail in FIG. 9.

FIG. 7 is a fragmentary horizontal cross-section of the bed taken generally at line 7–7 of FIG. 6 which illustrates how the manual drive unit slidingly engages the foot-end of the bed frame. Note slots 133 and 134 in side rails 59 and 55, respectively.

FIG. 9 is a fragmentary section taken generally at line 99 of FIG. 6 which illustrates how the drive unit latches onto the bed frame. Side rail 59 includes slot 133 which receives straight portion 135 of latch 125 to lock drive unit 11 into place. Thus it is seen that replacing or interchanging the manual drive unit with another drive unit (either manual or powered) is quickly and easily accomplished by turning latches 125 and 126 and sliding out the drive unit and then reversing the process with the replacement unit. Indeed, the entire interchange can be accomplished in less than 30 seconds.

Both the manual and powered drive units include identical coupling assemblies (three assemblies in each unit) for coupling the drive to the appropriate screw jacks. FIG. 8 is a vertical cross-section of the manual drive unit and coupling assembly taken generally at line 8—8 of FIG. 7. Since all three coupling assemblies are identical within the manual drive unit, only coupling assembly 140 is described herein. Handcrank 84 generally comprises handle 142 secured to crank arm 141 which is pivotally secured to shaft extension 138 at pivot pin 124. The crank arm may be rotated in a counterclockwise direction about pin 124 to provide clearance and avoid interference with the center hand crank. Drive unit shaft 143 and its shaft extension 138 extend through a bore in wall 158 of drive unit 11 and are secured by bearing 148. Drive unit shaft 143 also extends through a bore in bracket 145 where it is further secured by bushing 144. Mounted on the distal end of shaft 143 is pin 149. Coupling 150, which includes slot 151, slidingly engages shaft 143. Spring 146 extends between bushing 144 and coupling 150, biasing the coupling leftwardly until pin 149 abuts the rightward end of slot 151. Drive shaft 81' extends through bushing 152 (which includes internal bearings not shown) which is mounted to mounting clevis 154. Drive shaft extension 153 of shaft 81' includes pin 156 which engages an open-ended slot (shown more clearly in FIG. 12A) in the leftward end of coupling 150. Thus, it is seen how rotating handcrank 84 drives shaft 81' to cause jack 81 to operate.

Figures 10, 11, 12, 12A:
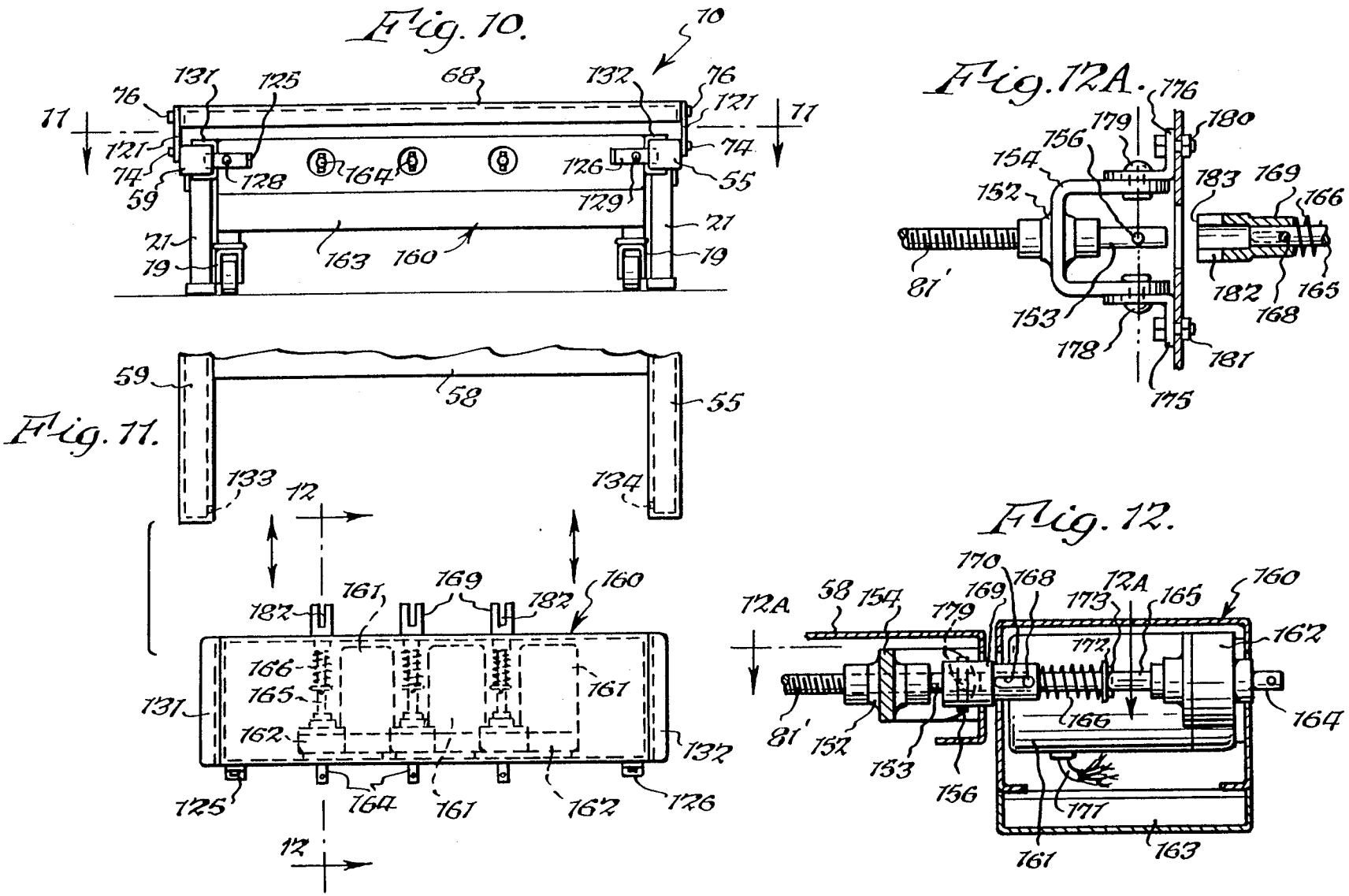
FIG. 10 is a view similar to FIG. 6, except illustrating the motor drive unit installed in the bed.
FIG. 11 is a view similar to FIG. 7, except illustrating the motor drive unit installed in the bed.
FIG. 12 is a view similar to FIG. 8, except illustrating the motor drive unit installed in the bed, and taken generally on line 12—12 in FIG. 11.
FIG. 12A is a partially exploded horizontal cross-section taken along line 12A—12A of FIG. 12, illustrating the coupling of the drive unit to the drive jack.

The motor drive unit 160 mounts in exactly the same manner as the manual drive unit, as shown in FIGS. 10, lit 12 and 12A. The obvious difference between the two units is that the handcranks of the manual unit are replaced by electric motors in the powered drive unit. FIG. 10 is a view similar to FIG. 6, except illustrating the motor drive unit installed in the bed, and FIG. 11 is a view similar to FIG. 7.

FIG. 12 illustrates a vertical cross-section of the motor drive unit and coupling assembly taken generally at line 12—12 of FIG. 11. Motor 161 is mounted to the drive unit housing and drives motor shaft 165 through gear reducer 162. The motor is controlled by motor control 163, also mounted to the housing. Motor leads 171 are shown disconnected but would of course be connected to control circuit 163. Not shown in the drawings is a clutch which engages the gear reducer when activated by control circuit 163. (Note that the clutch is optional and may not be necessary depending upon the gear ratio of the gear reducer.) In the event of motor failure or electrical failure the clutch is disconnected which permits the jack to be driven by an emergency handcrank which may be secured to shaft extension 164.

Mounted on motor shaft 165 are pins 168 and 173. Coupling 169, which includes slot 170, slidingly engages shaft 165. Spring 166 extends between washer 172 which abuts pin 173 and coupling 169, biasing the coupling leftwardly until pin 168 abuts the rightward end of slot 170. Drive shaft 81' extends through bushing 152 (which includes internal bearings not shown) which is mounted to mounting clevis 152. Drive shaft extension 153 of shaft 81' includes pin 156 which engages an open-ended slot (shown more clearly in FIG. 12A) in the leftward end of coupling 150. Thus, it is seen how the motor rotates shaft 81' to cause jack 81 to operate.

FIG. 12A is a partially exploded horizontal cross-section taken along line 12A–12A of FIG. 12, illustrating the coupling of the drive unit to the drive jack. Clevis 154 is pivotally mounted to angle brackets 175 and 176 at pivot bolts 178 and 179, respectively. Angle brackets 175 and 176 are fixedly secured to mounting bracket 58 by nut/bolt 180 and 181, respectively.

The pivoting action of controller shaft 81', and jack 81, is a subtle but important part of the present invention. This feature is perhaps best appreciated with respect to FIG. 5, which shows head section 66 in an elevated position. Since bracket 91 is rigidly secured to transverse member 94 (which in turn is part of head section 66) and pivotally secured to jack 81 at pin 88, it necessarily follows that jack 81 must be capable of vertical "play" as it operates. As shown in FIG. 5, jack 81 pivots through an angle theta as head section 66 is raised or lowered. This movement is made possible by the unique mounting of clevis 154 to bracket 58. It should be noted that all three jacks are mounted in the same way, and each pivots somewhat during operation, as shown in FIGS. 3-5.

FIG. 12A also illustrates the manner in which coupling 169 engages shaft 153. Cylindrical pin 156 is rigidly secured to, and extends outwardly on two sides from shaft 153. In operation, pin 156 engages slot 182 (shown in FIGS. 11 and 12A) of coupling 169 engages slot 182 (shown in FIGS. 11 and 12A) of coupling 169. When installing the drive unit, it is obviously unlikely that all three of the slotted couplings will align with their respective shaft pins (in fact, usually none of the couplings are aligned). With reference to FIG. 12A, for example, it is seen that as coupling 169 is moved leftwardly towards shaft 153 that pin 156 will come into contact with annular surface 183 of coupling 169. As the drive unit moves further leftward, spring 166 compresses, and continues to compress until the drive unit is latched into place by latches 125 and 126. Thus it is seen that the drive unit can be completely installed into the bed, and yet one or more of the couplings may not be engaged with its respective shaft. However, as the drive unit shaft is rotated relative to the jack drive shaft (which remains stationary due to its relatively large inertia) eventually slot 182 will become aligned with pin 156 and spring 166 will bias the coupling into mating engagement with the controller shaft. In other words, all three couplings will eventually spring into engagement with their respective controller shafts, as the controller shaft pins will "pop" into the slots of the coupling. This same mechanism operates with both the manual and powered drive units, and permits quick and simple interchangeability thereof.

It is sometimes desired to transport an adjustable bed from room to room or even from one building to another. In fact, it is much more likely that a need will arise to move an adjustable bed from place to place as compared to a conventional bed. To solve this problem, the bed of the present invention may be easily disassembled into two parts which then nest one within the other for compact storage and convenient transport. Adverting to FIG. 1, it is seen that the bed may be quickly disassembled by removing pins 61 and 62 which hold the frame side rails together, and by removing pins 88, 90, 105' and 184. Pins 184 and 105' hold head section **83*a* and foot section 83*b* of jack 83 together; pin 90 pivotally secures jack 82 to bracket 93; and pin 88 pivotally secures jack 81 to bracket 91**. Thus, the bed may be easily disassembled by removing six pins.

FIG. 13 is a side elevation of the adjustable bed of the invention, illustrating how the bed may be separated into two pieces which nest together which makes the bed easier to transport or store and FIG. 14 is a top plan elevation of the bed shown in FIG. 13. It should be noted that jacks 81, 82 and 83 are offset in position in such a way to accommodate nesting, i.e., the jacks do not interfere with one another when the bed halves are stacked as shown in FIGS. 13 and 14. This spacing and orientation of the jacks is best seen with respect to FIG. 1. Although the distance between jacks 82 and 83 is equal to the distance between jacks 81 and 83, jack 81 is closer to the bottom rails than jack 82 is to the top rails.

Figures 15A, 15B, 15C:
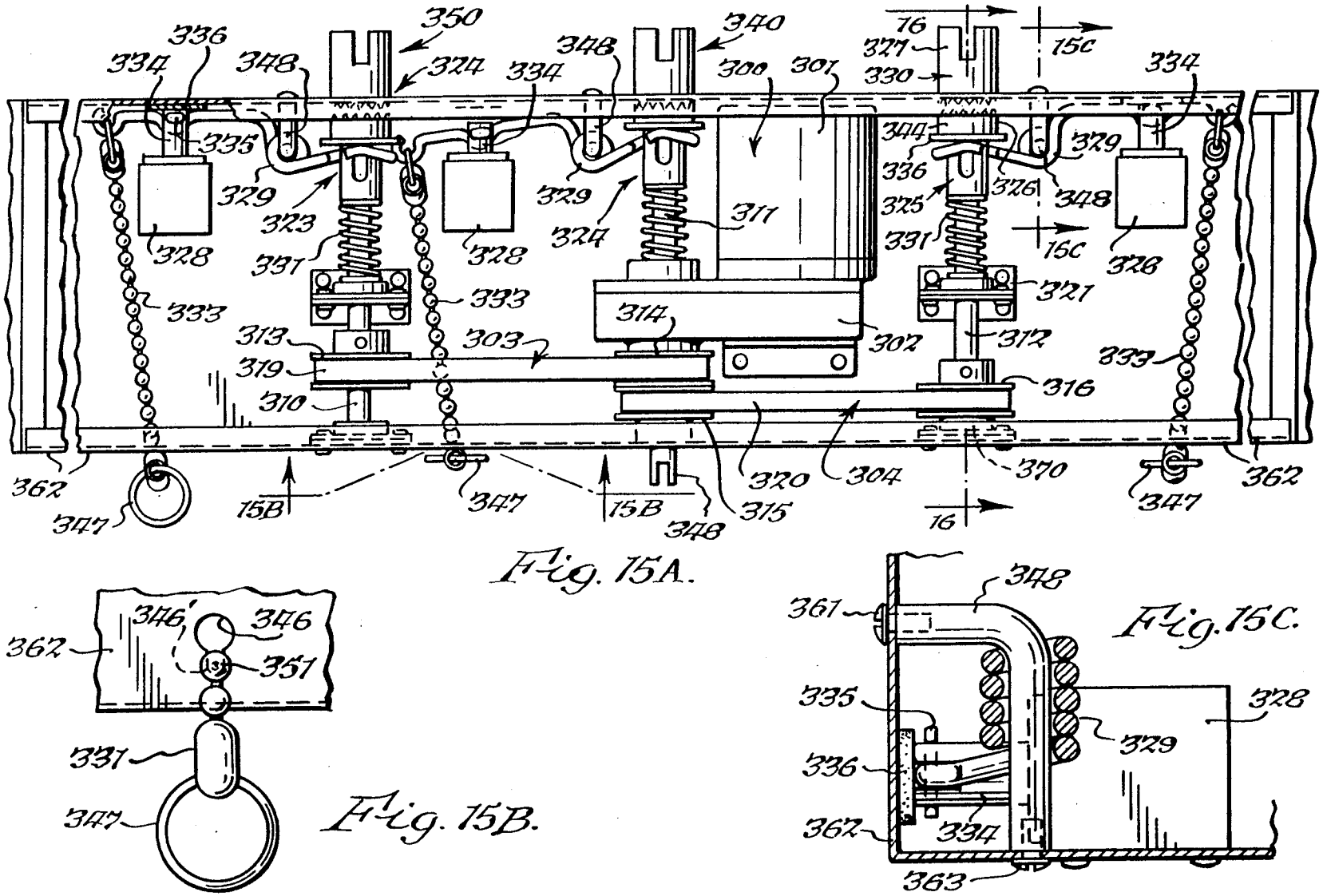
FIG. 15A is a top plan elevation of an alternative motor drive unit having a single motor and three clutches, taken just under the top wall of the drive unit housing.
FIG. 15B is a fragmentary elevation of a bead chain locking means to hold engagement of its clutch.
FIG. 15C is a fragmentary vertical section taken along line 15C—15C of FIG. 15A.

FIG. 15A is a top plan elevation of an alternative single-motor drive unit having a single motor and three toothed-gear clutch assemblies. Drive unit 300 comprises motor 301 which drives belt drives 303 and 304 through gear reducer 302. Belt drive 303 comprises drive sheave 314 which is mounted on gear reducer shaft 311, sheave 313 of head section drive 350 which is mounted on drive unit shaft 310, and belt 319 which loops about sheaves 313 and 314. Belt drive 304 comprises drive sheave 315 which is mounted on gear reducer shaft 311, sheave 316 of foot section drive 330 which is mounted on drive unit shaft 312, and belt 320 which loops about sheaves 315 and 316. Gear reducer shaft 311 drives bed elevation drive 340 directly. It is important to note that the placement and coupling of motor 301 and gear reducer 302 to center drive 340 (the bed elevation drive) enables all three drives to be driven using only two belts, which is an improvement over the embodiment disclosed and illustrated in the parent patent.

Each individual drive unit shaft may be coupled to its respective jack drive shaft by engagement of its toothed-gear clutch assembly. Electronic control circuitry (not shown) permits only one solenoid to be engaged at any one time. This is because, with a single motor drive, it is not possible to lower one section of the bed while raising another section, since each of these operations requires a different motor direction. Moreover, performing only one function at a time permits use of a lower horsepower motor, thereby reducing the cost of the drive unit.

Clutch assembly 323 is associated with drive unit shaft 310, clutch assembly 324 is associated with drive unit shaft 311 and clutch assembly 325 is associated with drive unit shaft 312. Since all three clutch assemblies are identical, only clutch assembly 325 will be described in detail, although the description is intended to describe the two remaining clutch assemblies. Moreover, since the clutch assemblies are identical, identical elements of the assemblies are labeled with the same reference numbers.

Clutch assembly 325 comprises toothed gear drive coupling 326, toothed gear jack drive coupling 327, solenoid 328, solenoid pivot spring 329, pivot post 348, first retaining spring 331, second retaining spring 332 (shown in FIG. 16A), and manual override pullchain 333. Solenoid 328 includes solenoid plunger 334 which travels into the solenoid body when the solenoid is energized. Solenoid pivot spring 329 is wrapped about pivot post 348 and a first end of the spring is fixedly secured to plunger 334 by Cotter pin 335 (shown in dotted lines in FIG. 16B). Pivot spring 329 is free to rotate about the pivot post. A second end of the spring is in contact with washer 336 which is secured about a shoulder of drive coupling 326. The drive coupling is biased toward the pulley sheave by spring 332 (shown in FIG. 16A), thereby maintaining contact between the second end of the pivot spring and the washer.

Figure 17:
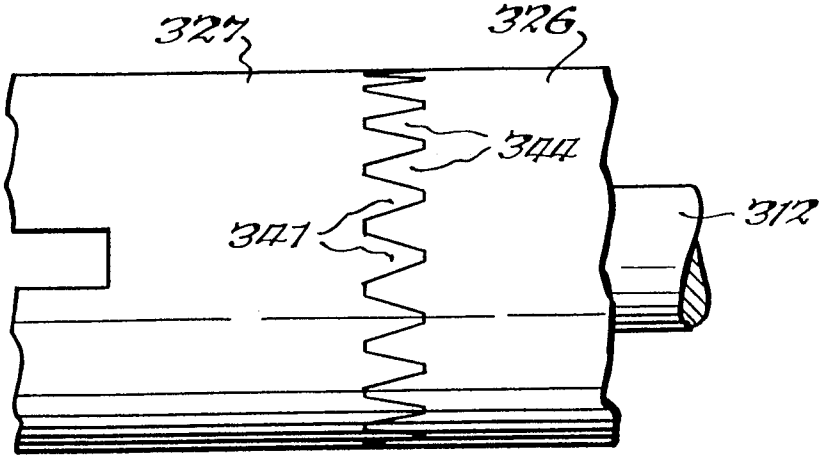
FIGS. 17 and 18 are plan views of the toothed gear couplings of the drive unit shown first engaged and then disengaged, respectively.
Figure 18:
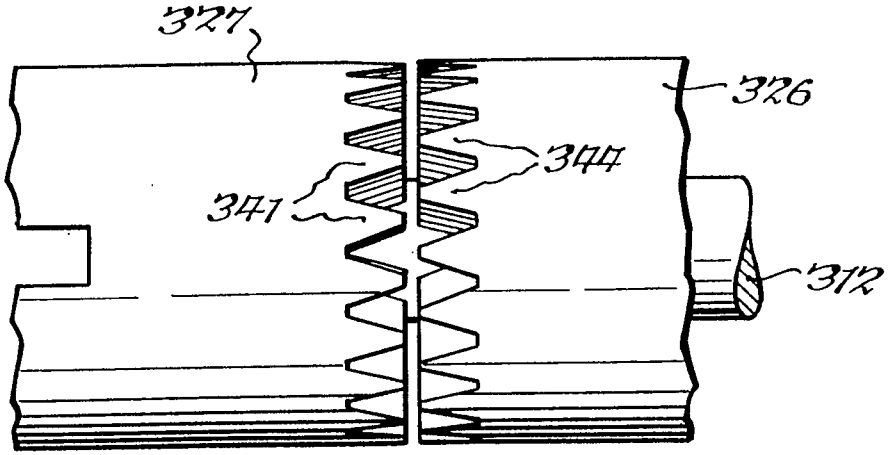

Drive coupling 326 is shown in an enlarged view in Figure 18, which illustrates tooth gear 344. Jack gear coupling 327 is also illustrated in FIG. 18, having teeth 341. FIG. 18 shows the two gears 326 and 327 disengaged or uncoupled, whereas Figure 17 shows the two gears engaged. Obviously, when the gears are engaged, the respective jack shaft rotates to raise or lower the particular bed section.

Referring again to FIG. 15A, couplings 323 and 325 are shown disengaged while coupling 324 is shown engaged. To engage coupling 325, solenoid 328 is energized which pulls plunger 334 into the solenoid housing. This causes pivot spring 329 to pivot about pivot post 348 in a clockwise direction, and urges washer 336 and coupling 326 toward coupling 327. It is important to note that use of the pivot spring enables use of a less powerful solenoid than would be required if the solenoid was linked to the coupler with a straight linkage. When the solenoid is de-energized, restoring spring 332 (shown in FIG. 16) causes the two coupling halves to disengage. Clutch assemblies 323 and 324 operate in exactly the same fashion, except the direction of rotation of the respective pivot springs is counterclockwise instead of clockwise when the solenoids are energized.

In the event of a solenoid failure or complete power failure, it may be necessary to engage one or more of the clutch assemblies manually. In FIG. 15A, drive 340 is shown as manually engaged. To manually engage drive 340, pullchain 333 is pulled through a keyhole slot of the front wall of the drive unit (shown in FIG. 15B) by ring 347. Below slot portion 346 is a narrower slot portion 346' which is smaller in diameter than individual bead 351 of pullchain 333. As the pullchain is pulled, the pivot spring pivots about the pivot post and urges the coupling halves into engagement. Once engaged, the pullchain is locked by sliding bead 351 downward such that the bead of the pullchain is precluded by the smaller slot from passing back into the housing of the drive unit. Once the clutch is engaged, a manual crank handle can be secured to shaft extension 348 which extends out the front of the drive unit. The manual crank operates as described supra. For simplicity, only one shaft extension 348 is shown in FIG. 15A, although each drive has such an extension.

Figure 16A:
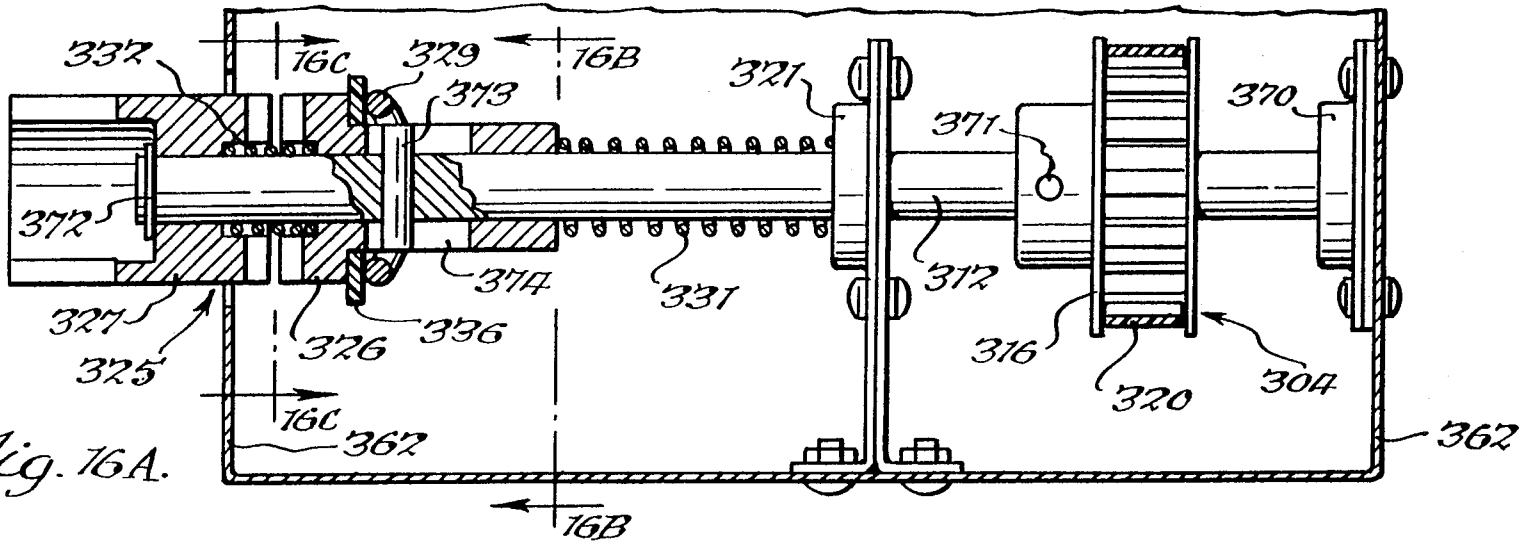
FIG. 16A is a vertical section taken along line 16A—16A of FIG. 15A.
Figure 16B:
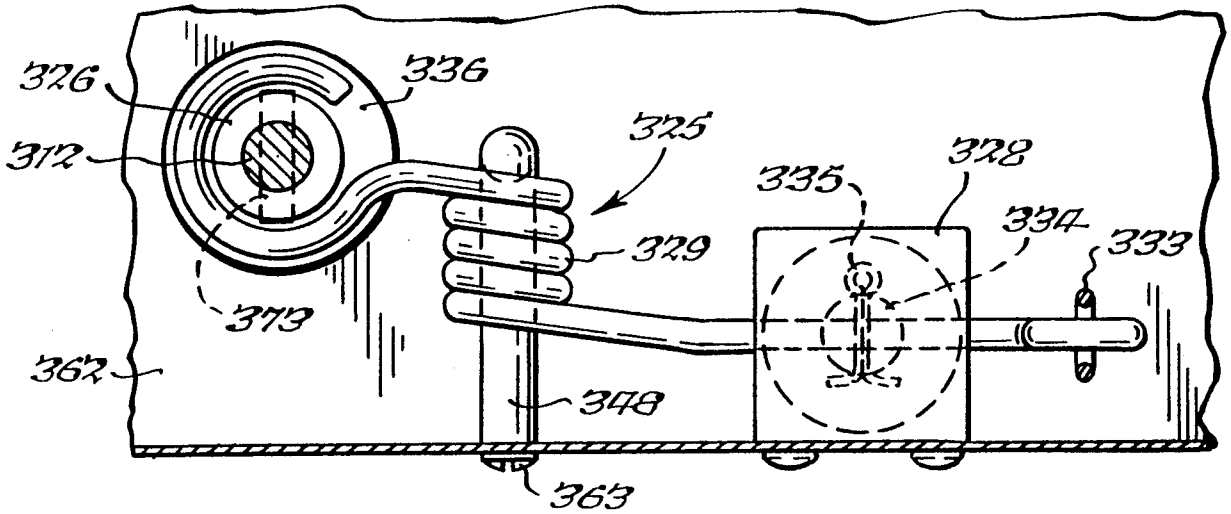
FIG. 16B is a vertical section taken along line 16B—16B in FIG. 15A, showing a solenoid and its operating pivot arm.

FIGS. 15C and 16B illustrate how pivot spring 329 is secured to solenoid plunger 334 by Cotter pin 335. Rubber pad 365 is secured to the inner surface of drive unit housing wall 362 to cushion the plunger and prevent it from striking the wall when the clutch is disengaged. Pivot post 348 is secured to the housing wall by screws 361 and 363, respectively. As shown in both FIGS. 15C and 16B, spring 329 wraps about and is free to rotate about the vertical section of post 348. An arcuate end of spring 329 is in contact with washer 336 which rides on a shoulder of coupling 326.

FIG. 16A is a partial cross-sectional view of drive 330 taken generally along line 16A—16A of FIG. 15A. As shown in the drawing, shaft 312 is supported by bearing 370 which is secured to drive unit housing wall 362. The shaft is further supported by bearing 312. Sheave 316 is fixedly secured to shaft 312 by a set screw 371. Drive coupling 326 is secured to the shaft in a manner such that it rotates with the shaft but is free to slide a short distance axially along the shaft. In the embodiment shown, pin 373 is secured within a radial through-bore of the shaft and extends through slot 374 of coupling 326. Thus it is seen that the coupling must rotate with the shaft but is free to travel a short distance defined by the length of slot 374. Jack gear coupling 327 includes a through-bore which is larger in diameter than the outer diameter of shaft 312, such that coupling 327 is free to rotate about the shaft. Shaft 312 includes a circumferential groove at one end where a U-shaped retaining clamp 372 is mounted to secure coupling 327 to the shaft. Spring 332 surrounds shaft 312 between couplings 327 and 326 and functions to prevent the couplings from inadvertently engaging. As shown in the drawing, spring 332 abuts circular grooves in both couplings, which grooves are located underneath the teeth of the couplings (closer to the centerline of the shaft). Spring 331 surrounds shaft 312 between bearing 321 and coupling 326 and functions to maintain slight tension on spring 332, thereby maintaining the relative positions of the couplings on the shaft. Washer 336 is fixedly secured about a shoulder of coupling 326, and pivot spring 329 contacts the washer as shown in both FIGS. 16A and 16B. When solenoid 328 is energized, pivot spring 329 urges coupling 326 leftward, (as shown in Figure 16A) overcoming the force of spring 332 and forcing the teeth of coupling 326 to engage the teeth of coupling 327, thus forcing coupling 327 to rotate with the shaft. Springs 329 and 331 together push coupling 327 towards the bed drive shaft and the slotted end of the coupling engages the pin on the bed drive shaft as described infra with respect to FIG. 12A. When the solenoid is de-energized, spring 332 separates the couplings, thereby disengaging the clutch.

Figure 16C:
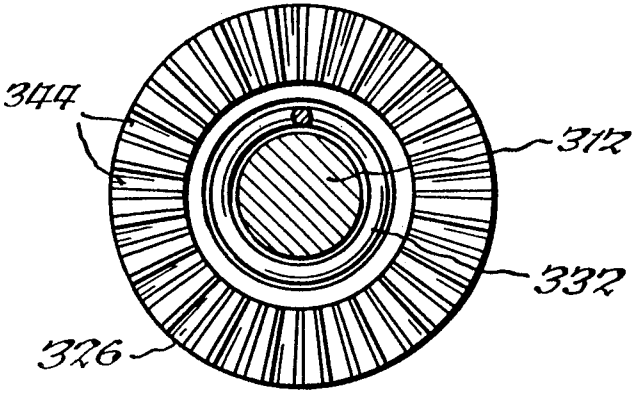
FIG. 16C is a vertical section taken along line 16C—16C in FIG. 16A.

FIG. 16C is a cross-sectional view taken along line 16C—16C in FIG. 16A, and shows a face view of the teeth 344 of coupling 326.

Figure 19:
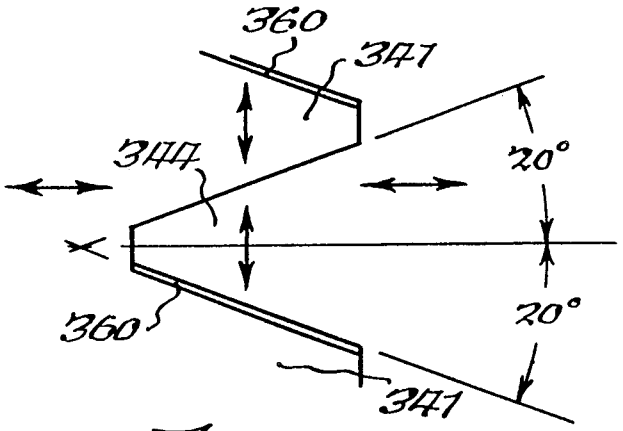
FIG. 19 is a diagrammatic representation of the two toothed members showing an angle of about 20 degrees between tooth faces and also showing their bottoming arrangement which prevents wedging of binding of the teeth.

FIG. 19 is a diagrammatic view of intermeshing teeth 341 and 344 showing a clearance 360 maintained to prevent wedging of the teeth 344 into and between the teeth 341. As shown in the drawing, in a preferred embodiment the tooth faces have a pitch of approximately 20 degrees as measured from a bisecting line between adjacent teeth to a face of the tooth. Experiments indicate that other angles are also suitable and an approximate range of 20 to 30 degrees affords suitable results. The larger the angle, the less likely are the gears to bind up when disengaging, but the more torque is required to drive the jack screw. Thus, the object is to find the minimum angle at which bind-up will not occur. It should also be noted in FIGS. 17, 18 and 19 that all of the teeth have flattened tips and that the spaces between teeth are flattened as well. This flattening of the teeth also functions to prevent the gears from binding up when disengaging. Finally, when the teeth are engaged and driving the jack screw, only one tooth face engages a corresponding tooth face when driving in one direction, while the remaining tooth face is separated by its corresponding tooth face by a clearance, indicated generally as 360 in FIG. 19. Obviously, when the motor reverses the formerly non-contacting tooth faces would engage and the clearance would exist between the formerly contacting faces. This clearance is of course necessary for the teeth to properly mesh, and also helps to prevent bind-up when disengaging.

It will thus be seen that the objects set forth above, among those made apparent from the preceding description, are efficiently obtained. Since certain changes may be made in carrying out the above-described invention and in the construction set forth without departing from the scope of the invention, it is intended that all matter contained in the above description or shown in the accompanying drawings be interpreted as illustrative and not in a limiting sense. It is also to be understood that the following claims are intended to cover all of the generic and specific features of the invention herein described, and all statements of the scope of the invention, which, as a matter of language, might be said to fall therebetween.

What is claimed is:

1. A drive unit for an adjustable bed, comprising:

motor means; and, a clutch assembly comprising a toothed gear jack drive coupling, a toothed gear drive coupling and means for engaging and disengaging said jack drive coupling and said drive coupling, wherein said drive coupling is driven by said motor means and wherein said jack drive coupling, when engaged with said drive coupling by said clutch assembly, drives a controller shaft of said adjustable bed to raise or lower a section of said bed. wherein said means for engaging and disengaging said jack drive coupling and said drive coupling comprises a solenoid having a solenoid plunger which is coupled to said drive coupling through a pivot spring which is operatively arranged to move said drive coupling into engagement with said jack drive coupling when said solenoid is energized, and also includes a spring located between said drive coupling and said jack drive coupling which functions to separate and disengage said couplings when said solenoid is de-energized.

2. A drive unit for an adjustable bed as recited in claim 1 wherein the teeth of said toothed gear jack coupling and said toothed gear drive coupling are flattened on their tips to prevent binding up of said couplings when disengaging.

3. A drive unit for an adjustable bed as recited in claim 1 wherein adjacent teeth of said toothed gear jack coupling and said toothed gear drive coupling are pitched at an angle of approximately 20 degrees as measured from a tooth face to a bisecting line between adjacent teeth.

4. A drive unit for an adjustable bed as recited in claim 1 wherein adjacent teeth of said toothed gear jack coupling and said toothed gear drive coupling are pitched at an angle of approximately 30 degrees as measured from a tooth face to a bisecting line between adjacent teeth.

5. An adjustable bed and drive unit therefor, comprising:

a bed frame;

a plurality of separately adjustable bed sections pivotally secured to said frame;

a corresponding plurality of controller shafts wherein each shaft controls one of said adjustable sections;

a drive unit operatively arranged for controlling and driving said controller shafts, wherein said drive unit comprises:

motor means;

a separate clutch assembly for each controller shaft comprising a toothed gear jack drive coupling, a toothed gear drive coupling and means for engaging and disengaging said jack drive coupling and said drive coupling;

wherein said means for engaging and disengaging said jack drive coupling and said drive coupling comprises a solenoid having a solenoid plunger which is operatively arranged to move said drive coupling into engagement with said jack drive coupling when said solenoid is energized, and also includes a spring located between said drive coupling and said jack drive coupling which functions to separate and disengage said couplings when said solenoid is de-energized.

6. A drive unit for an adjustable bed, comprising:

motor means; and, a clutch assembly comprising a toothed gear jack drive coupling, a toothed gear drive coupling and means for engaging and disengaging said jack drive coupling and said drive coupling wherein said drive coupling is driven by said motor means and wherein said jack drive coupling, when engaged with said drive coupling by said clutch assembly, drives a controller shaft of said adjustable bed to raise or lower a section of said bed wherein said toothed gear drive coupling is mounted on a drive unit shaft within said drive unit and rotates with said drive unit shaft whenever said motor means is energized and is axially movable upon said drive unit shaft, and wherein said jack gear coupling is also mounted upon said drive unit shaft but is free to rotate independently from said drive unit shaft when disengaged from said drive coupling but rotates with said drive unit shaft when engaged with said drive coupling, and wherein said jack gear coupling contains an open-ended slot which engages a pin of a bed drive shaft to raise or lower a section of said bed when said jack gear coupling and said drive coupling are engaged.

7. A drive unit for an adjustable bed as recited in claim 6 wherein the teeth of said toothed gear jack coupling and said toothed gear drive coupling are flattened on their tips to prevent binding up of said couplings when disengaging.

8. A drive unit for an adjustable bed as recited in claim 6 wherein adjacent teeth of said toothed gear jack coupling and said toothed gear drive coupling are pitched at an angle of approximately 20 degrees as measured from a tooth face to a bisecting line between adjacent teeth.

9. A drive unit for an adjustable bed as recited in claim 6 wherein adjacent teeth of said toothed gear jack coupling and said toothed gear drive coupling are pitched at an angle of approximately 30 degrees as measured from a tooth face to a bisecting line between adjacent teeth.

10. An adjustable bed and drive unit therefor, comprising:

a bed frame;

a plurality of separately adjustable bed sections pivotally secured to said frame;

a corresponding plurality of controller shafts wherein each shaft controls one of said adjustable sections;

a drive unit operatively arranged for controlling and driving said controller shafts, wherein said drive unit comprises;

motor means;

a separate clutch assembly for each controller shaft comprising a toothed gear jack drive coupling, a toothed gear drive coupling and means for engaging and disengaging said jack drive coupling and said drive coupling;

means for coupling said motor means to said clutch assembly, wherein said drive coupling is driven by said motor means and wherein said jack drive coupling, when engaged with said drive coupling by said clutch assembly, drives a controller shaft of said adjustable bed to raise or lower a section of said bed wherein said toothed gear drive coupling is mounted on a drive unit shaft within said drive unit and rotates with said drive unit shaft whenever said motor means is energized and is axially movable upon said drive unit shaft, and wherein said jack gear coupling is also mounted upon said drive unit shaft but is free to rotate independently from said drive unit shaft when disengaged from said drive coupling but rotates with said drive unit shaft when engaged with said drive coupling, and wherein said jack gear coupling contains an open-ended slot which engages a pin of a bed drive shaft to raise or lower a section of said bed when said jack gear coupling and said drive coupling are engaged.

* * * * *